US006367091B1

(12) United States Patent
Chiang

(10) Patent No.: US 6,367,091 B1
(45) Date of Patent: Apr. 9, 2002

(54) SWIMMING GOGGLES

(76) Inventor: Herman Chiang, 11F-2, No 634-P, Ching-ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/563,580

(22) Filed: May 3, 2000

(51) Int. Cl.[7] ..... A61F 9/02
(52) U.S. Cl. ..... 2/428; 2/452; 351/43
(58) Field of Search ..... 2/428, 430, 452; 351/43

(56) References Cited

U.S. PATENT DOCUMENTS

| | | | | | |
|---|---|---|---|---|---|
| 4,087,865 | A | * | 5/1978 | Garofalo | 2/428 |
| 5,410,763 | A | * | 5/1995 | Bolle | 2/436 |
| 5,572,989 | A | * | 11/1996 | Lutz et al. | 128/201.18 |
| 5,617,588 | A | * | 4/1997 | Canavan et al. | 2/428 |
| 5,742,946 | A | * | 4/1998 | Garofalo | 2/428 |
| 5,802,622 | A | * | 9/1998 | Baharad et al. | 2/434 |
| 5,819,321 | A | * | 10/1998 | Wang | 2/428 |

* cited by examiner

*Primary Examiner*—John J. Calvert
*Assistant Examiner*—Katherine Moran
(74) *Attorney, Agent, or Firm*—Pro-Techtor International Services

(57) ABSTRACT

A type of swimming goggles, comprising the following: a monobloc formation made of flexible materials and composed of a lens frame unit, a nose bridge and a protective pad, and a lens made of rigid materials, characterized in that: the lens frame unit comprises a front frame unit and a rear frame unit, the front frame unit has a nose bridge that joins the upper and lower frame parts of the front frame unit to form a left and a right frame openings, and the two frame openings respectively have accommodating grooves; the rear frame unit is an appropriate extension horizontally extending from the rim of the front frame unit; and the protective pad is located a step lower than the rear frame unit and tapered off along the rim to the outside; on the rim of the lens and in the area corresponding to the nose bridge are respectively filling holes to enable firmer fastening of the lenses in the nose bridge and in the accommodating grooves on the frame openings of the front frame unit. The protective pad, having the function of a face mask, will cover both eyes in a same space and press on the face area surrounding the eye pits, thus providing comfortable contact with the user's face.

12 Claims, 6 Drawing Sheets

SWIMMING GOGGLES

FIELD OF THE INVENTION

This invention relates to a type of swimming goggles, particularly the one with lenses formed in a monobloc that can be planted to become one unit with a lens frame unit, a nose bridge and a protective pad, while the protective pad will cover both eyes within a same space to provide the user with a wider vision.

BACKGROUND OF THE INVENTION

The conventional type of swimming goggles for swimming pools is equipped with protective pads. But, as shown in FIG. 6, the conventional swimming goggles involve protective pads that cover the areas surrounding the eye pits, the protective pads will have a sucking force acting on the areas surrounding the eye pits. Therefore, the wearer's eyes will have an uncomfortable feeling of being compressed after they are worn for a period of time, or particularly after diving into the water. Furthermore, conventional swimming goggles have two lenses, at left and right sides, whether they are fixed thereon by inserting or planting, resulting in sophisticated assembling processes and a limited visibility.

OBJECTIVES OF THE INVENTION

It is therefore a major objective of this invention to provide a type of swimming goggles for swimming pools, involving a protective pad functioning as a mask to cover both eyes of the user in a same one space. Furthermore, the area covered by the mask will be outside the eye pits, therefore, there will be no feeling of eyeballs being pressed, the user then can feel comfortable contact with the mask. Because the lens is planted as one monobloc piece, it will provide firm and convenient assembling effects, as well as broader visibility because of its larger area.

CHARACTERISTICS OF THE INVENTION

The invention of swimming goggles is characterized in that: the lens frame unit, the nose bridge and the protective pad composing the invention of swimming goggles are made of flexible materials, in which, the lens frame unit comprises a front frame unit and a rear frame unit. The front frame unit has a nose bridge that joins the upper and lower parts of the front frame unit to form left and right frame openings, the two frame openings respectively having accommodating grooves; the rear frame unit extending horizontally from the rim of the front frame unit. The protective pad is located a step lower than the rear frame unit, and tapered off from the rim to the end; the two lenses of the swimming goggles are made of rigid materials, their rims and nose bridge being planted and fixed into the accommodating grooves and the nose bridge that are planted into the frame openings of the front frame unit.

Same as the aforementioned characteristics, there are filling holes on the rim of the lens formed in monobloc and on the joining part, so the filling agent can reinforce firmer assembly with the front frame unit. Furthermore, there are more filling holes on the joining part than on the rims, in order to reinforce the assembly of the nose bridge with the joining part.

Another characteristic of the invention of swimming goggles lies in that: at the left and right sides of the rear frame unit are extended sections for the purpose of connection with the headbands. On the extended section is a joining unit that can be joined with one end of the headband.

BRIEF DESCRIPTION OF NUMERALS

| | | | |
|---|---|---|---|
| 1 | swimming goggles | 10 | lens frame unit |
| 11 | nose bridge | 12 | protective pad |
| 13 | lens | 14 | headband device |
| 101 | front frame unit | 102 | rear frame unit |
| 103, 104 | frame opening | 105 | accommodating groove |
| 106 | extended section | 2 | joining unit |
| 107 | reinforced ribs | 108 | snap hole |
| 20 | first joining piece | 21 | second joining piece |
| 201 | joining post | 202, 212 | clasp groove |
| 211, 212 | joining groove | 213 | clasp post |
| 14 | headband device | 141 | headband |
| 142 | adjusting snap | | |

PREFERRED EMBODIMENT

Figure 1:
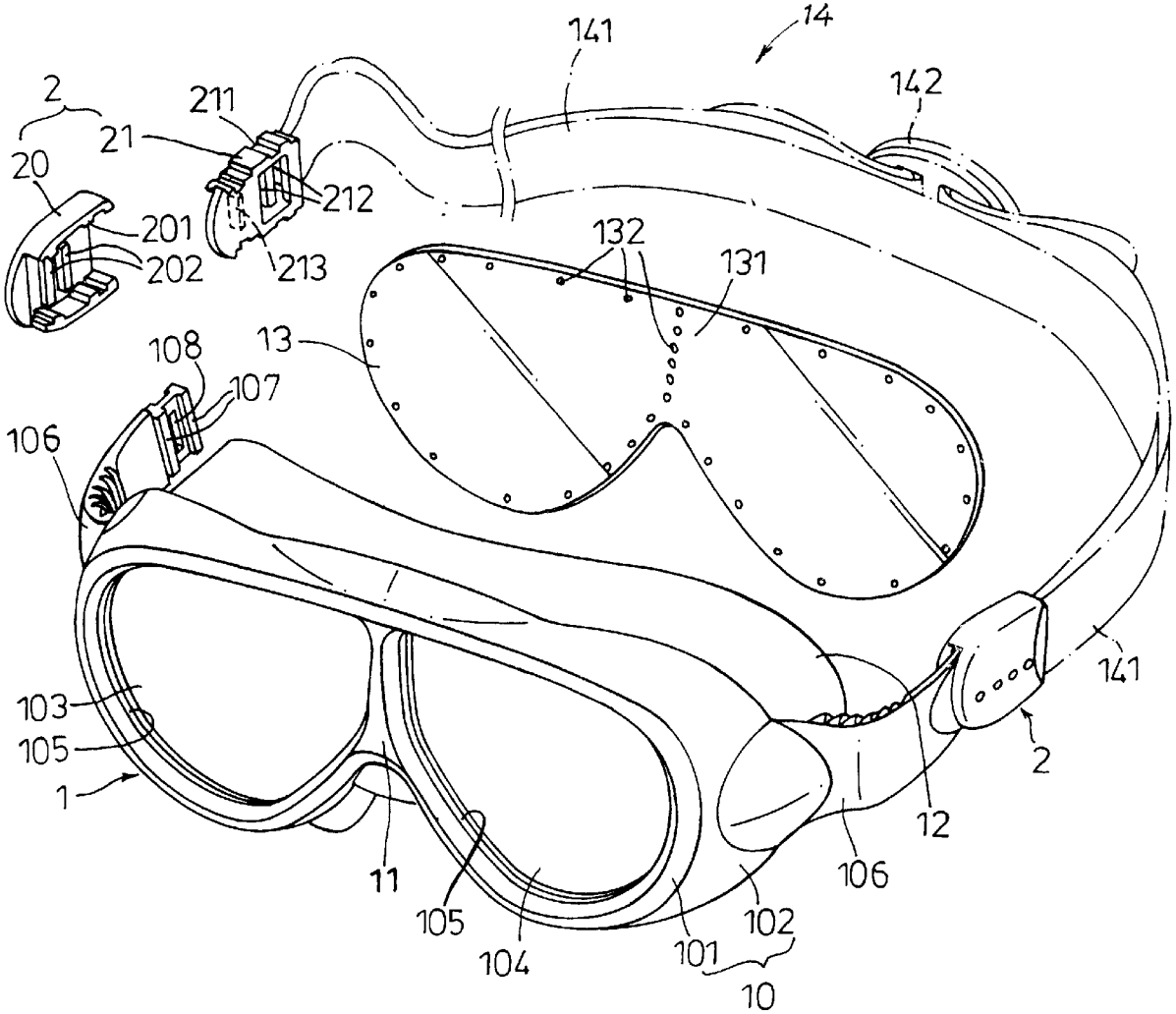
FIG. 1 is a perspective, disassembled view of the invention of swimming goggles.
Figures 3, 3A, 3B:
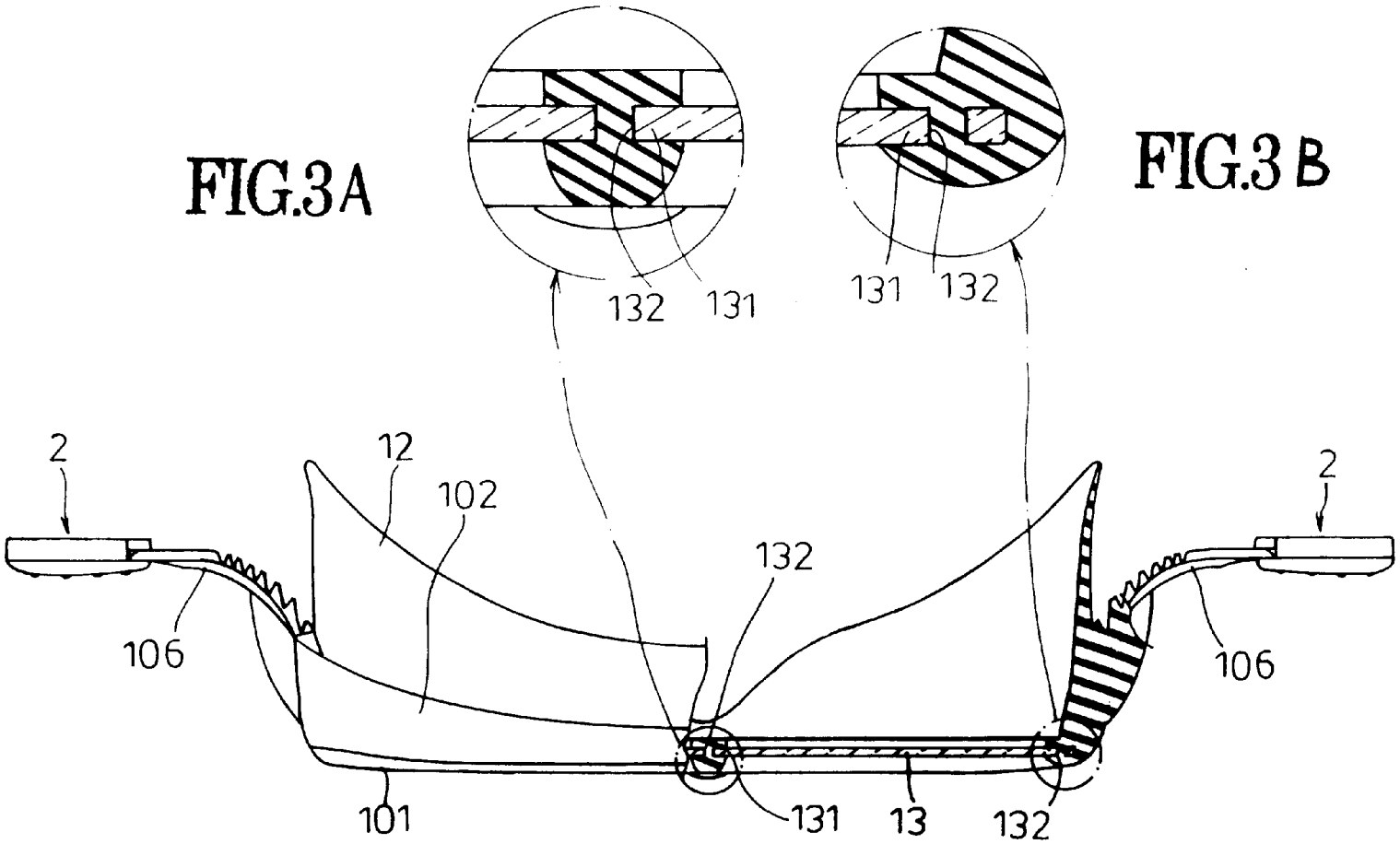
FIGS. 3 and 4 are section views of part of the invention of swimming goggles, in crosswise and lengthwise directions.
FIGS. 3A–3B is a close-up of part of FIG. 3.
Figure 4:
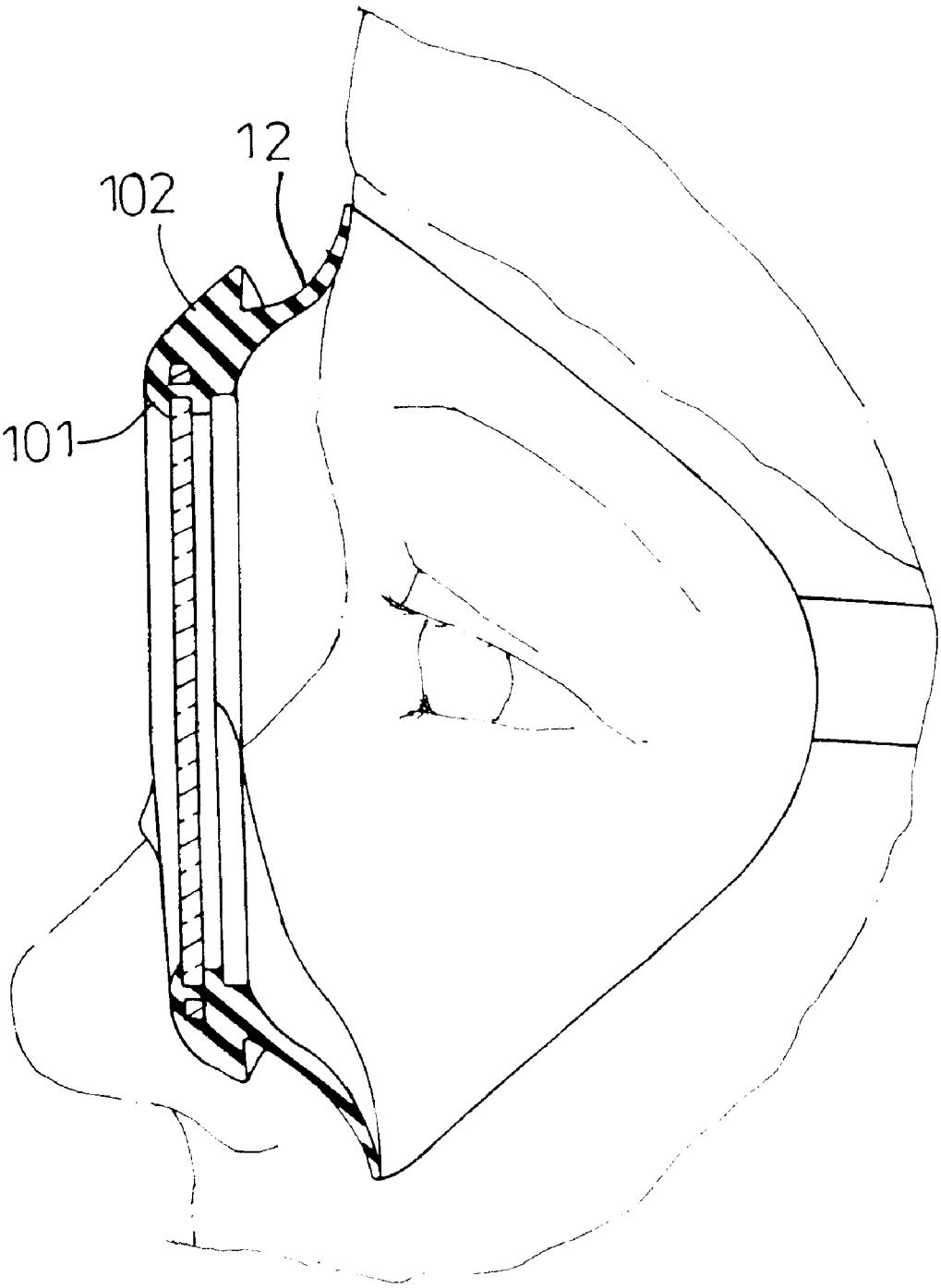

Referring to FIG. 1, the subject invention of swimming goggles 1 comprises the following: a monobloc formation made of flexible materials and comprising a lens frame unit 10, a nose bridge 11 and a protective pad 12, and a monobloc formation made of rigid materials and comprising a lens 13 and a headband device 14, wherein, the said lens frame unit 10 is composed of a front frame unit 101 and a rear frame unit 102. The front frame unit 101 involves a nose bridge 11 that joins the upper and lower parts of the front frame unit 101 to form two frame openings 103, 104, on the right and left sides. Each of the two frame openings 103, 104 has an accommodating groove 105 to accommodate a lens 13. The rear frame unit 102 is an appropriate extension that extends horizontally from the rim of the front frame unit 101, with extended sections 106 on two sides. On the extended section 106 are reinforced ribs 107 and a snap hole 108, which serve to fastened a joining unit 2 of the headband device 14. The joining unit 2 is composed of a first joining piece 20 and a second joining piece 21. On the first joining piece 20 is a joining post 201, and on the second joining piece 21 is a matching joining groove 211, the joining post 201 and the joining groove 211 can be snapped tight when the two joining pieces are fastened together. The two joining pieces 20, 21 respectively have their clasp grooves 202, 212 and clasp post 213, that serve to accommodate the headband device 14 (to be described later). As shown in FIG. 4, the protective pad 12 is located a step lower than the rear frame unit 102, extending and tapering off from the rim, to press against the lower parts of the eyebrows and the eye pits, and providing comfortable contact with the user's face, as shown in FIG. 4. As shown simultaneously in FIGS. 3 and 3A, the lens 13 is made of a rigid material in the shape of a plate, with an outline slightly larger than the front frame unit 101, at its surrounding and central parts 131 are filling holes 132, which serve to deposit filling agent before the front frame unit 101 is assembled, so the lens 13 can be more firmly assembled with the front frame unit 101. One point worth mentioning is that, there are more filling holes 132 at the central part 131 of the lens 13 than on its rim, so as to reinforce the adhesion between the nose bridge 11 and the connecting part 131.

The headband device 14 comprises two headbands 141 and an adjusting snap 142. The end of each of the two headbands 141 to be fastened with the joining unit 2 of the extended section 106 is joined as one unit with the second joining piece 21. To assemble, the reinforced ribs 107 of the extended section 106 are accommodated between the clasp grooves 202, 212 on the first and the second joining units 20, 21. The clasp post 213 is inserted in the clasp hole 108, and by mutual engagement of the joining post 201 and the joining groove 211 of the first and second joining pieces 20, 21, the extended sections 106 are joined to the two headbands 141 as one unit. In other words, the two headbands 141, 142 are joined as one unit by fastening the first and second joining pieces 20, 21 of the joining units 2 to the extended sections 106.

Figure 2:
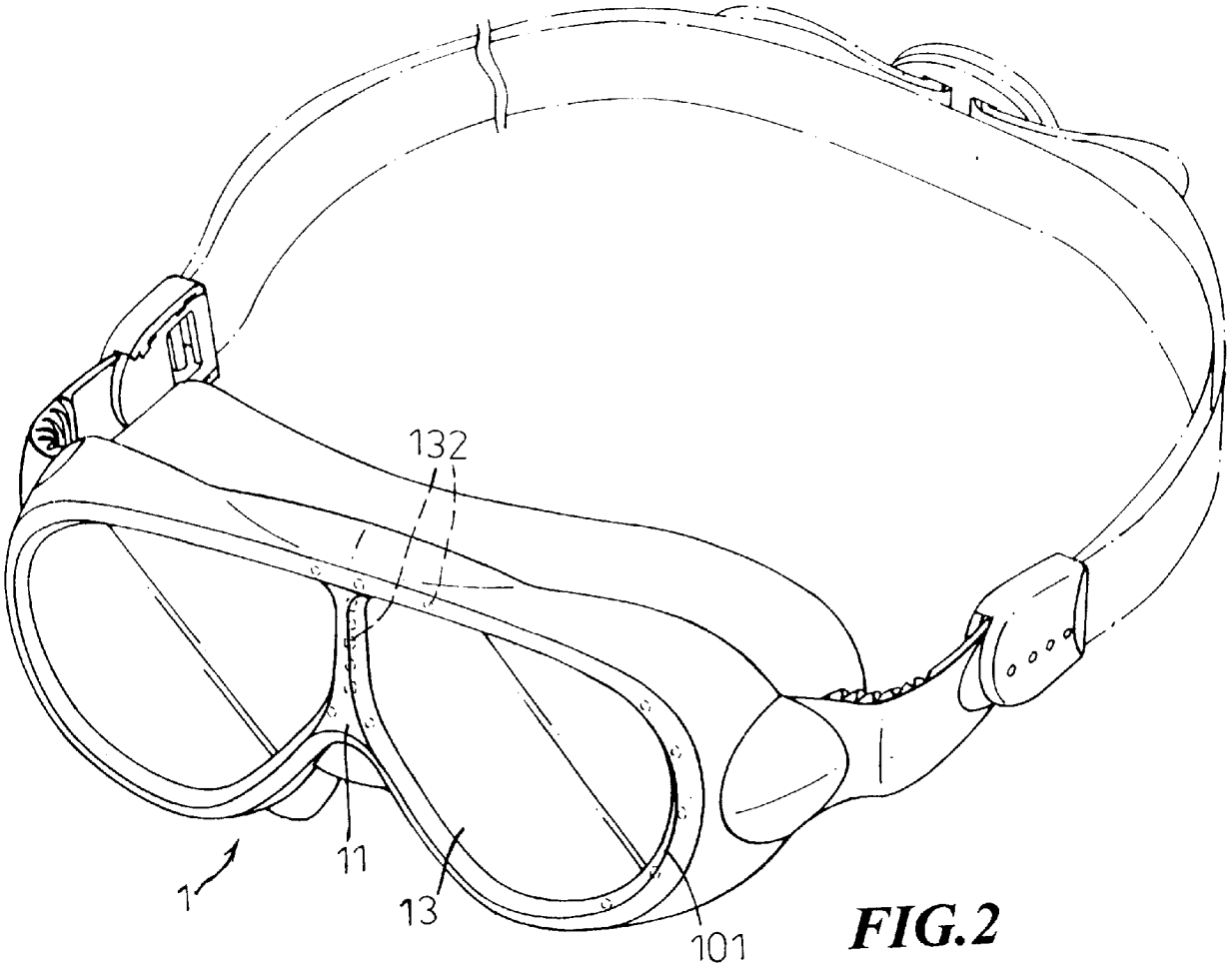
FIG. 2 is a perspective, assembled view of the invention of swimming goggles.
Figure 5:
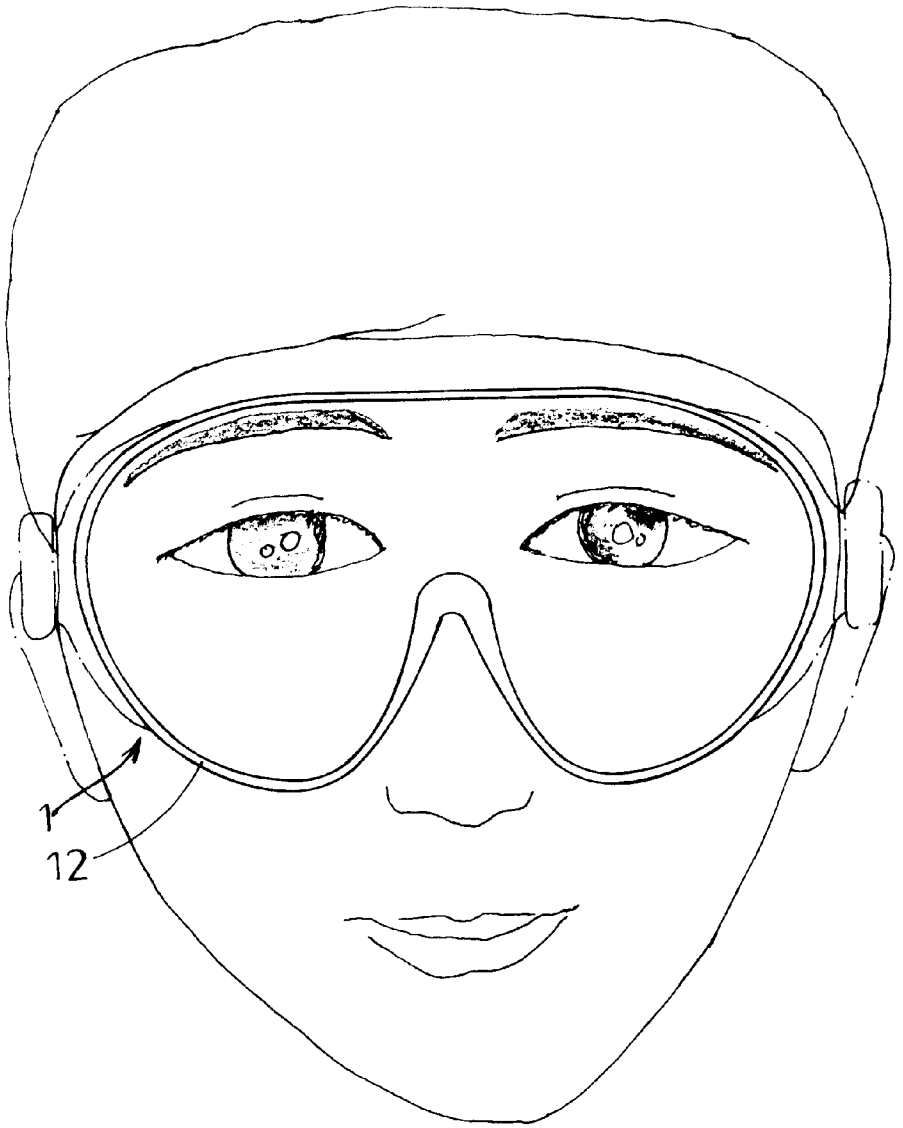
FIG. 5 illustrates how the invention of swimming goggles is worn, showing the protective pad and frame covering two eyes in one space.
Figure 6:
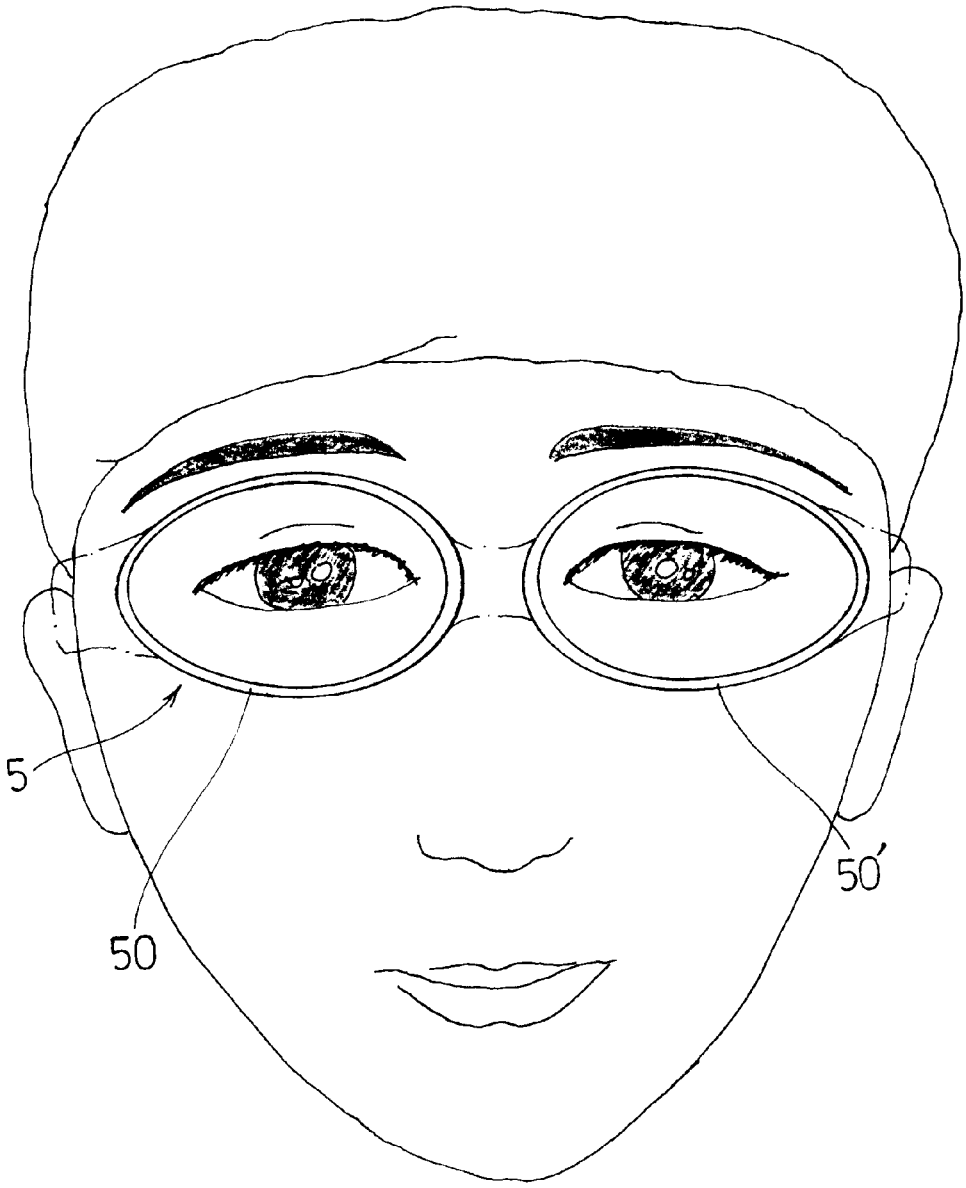
FIG.6 PRIOR ART
FIG. 6 illustrates how a prior art of swimming goggles is worn, showing the protective pad and frame covering two eyes separately.

Referring to FIG. 2, with the assistance of the filling holes 132, the lenses 13 of the invention of swimming goggles 1 can be fastened more firmly with the front frame unit 101 to prevent water seepage. The front frame unit 10 has the nose bridge 11 to join its upper the upper and lower parts, and lenses 13 have a plurality of filling holes 132 to reinforce the fastening strength, thus ensuring no deformation of the front frame unit 101. Furthermore, as shown clearly in FIG. 5, the protective pad 12 provided by the invention of swimming goggles 12 serves to cover the user's both eyes within a same space, pressing on the areas around the eye pits (shown in FIG. 4), therefore providing comfortable contact with the user's face. Moreover, as mentioned above, the entire monobloc of the lenses 13 is planted firmly, and the larger area formed by the lenses will provide wider and better viewing effects.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretations so as to encompass all such modifications and similar arrangements.

What is claimed is:

1. Swimming goggles comprising:

a flexible monobloc base and a rigid lens, said base comprises a lens frame unit, a nose bridge and a protective pad; wherein said lens frame unit comprises a front frame unit and a rear frame unit, said front frame unit having a nose bridge to join upper and lower parts of said front frame unit, said lens frame unit further comprising a left frame opening and a right frame opening, said frame openings and said nose bridge having an accommodating groove therein, said rear frame unit extends from a rim of said front frame unit, and said protective pad is connected to an interior of said rear frame unit and extends from a rim of said rear frame unit, said lens comprises a plurality of holes situated around a periphery of said lens and at a central area of said lens at an area corresponding to said nose bridge, said lens being received in said accommodating groove in said frame openings of said front frame unit and said nose bridge, and said lens comprising a greater concentration of said holes at said area corresponding to said nose bridge, said holes serving to receive a bonding agent to securely bond said lens to said nose bridge.

2. The swimming goggles as recited in claim 1, wherein:

said protective pad extending from said rear frame unit is tapered.

3. The swimming goggles as cited in claim 1, wherein:

extended sections including a plurality of reinforced ribs are provided at left and right sides of said rear frame unit to receive ends of a headband device, said headband device being connected to said extended sections by joining units, said joining units clasping said reinforced ribs; wherein each said joining unit comprises a first joining piece and a second joining piece, said first joining piece comprises a joining post, and said second joining piece comprises a corresponding joining groove, and said first joining piece and said second joining piece each comprise a clasp groove, said clasp groove receiving a selected one of said reinforced ribs, said joining post and said joining groove serving to connect said first and said second joining pieces.

4. The swimming goggles as cited in claim 3, wherein:

said first joining piece has a snap post, and snap holes are located between said reinforced ribs of said extended section, such that when said first joining piece is engaged with said second joining piece, said snap post is inserted into said snap hole.

5. The swimming goggles as cited in claim 4, wherein:

a portion of said front frame unit below said nose bridge conforms to a shape of a nose ridge of a user.

6. The swimming goggles as cited in claim 4, wherein:

said headband device comprises two headband straps and an adjusting snap, ends of said two headband straps being received in said joining units.

7. Swimming goggles comprising:

a flexible monobloc base and a rigid lens, said base comprises a lens frame unit, a nose bridge and a protective pad; wherein said lens frame unit comprises a front frame unit and a rear frame unit, said front frame unit having a nose bridge to join upper and lower parts of said front frame unit, said lens frame unit further comprising a left frame opening and a right frame opening, said frame openings and said nose bridge an accommodating groove therein, said rear frame unit extends from a rim of said front frame unit, and said protective pad is connected to an interior of said rear frame unit and extends from a rim of said rear frame unit, said lens comprises a left lens section and a right lens section, each said lens section covering one eye of a user, and said lens comprising a plurality of holes situated around a periphery of said lens, and said lens at a central area between said left lens section and said right lens section comprising a further plurality of holes, said lens being received in said accommodating groove in said frame openings of said front frame unit and said nose bridge, and said lens comprising a greater concentration of said holes at said central area between said left lens section and said right lens section than at said periphery of said lens, said holes serving to receive a bonding agent to securely bond said lens to said nose bridge.

8. The swimming goggles as recited in claim 7, wherein:

said protective pad extending from said rear frame unit is tapered.

9. The swimming goggles as cited in claim 7, wherein:

extended sections including a plurality of reinforced ribs are provided at left and right sides of said rear frame unit to receive ends of a headband device, said headband device being connected to said extended sections by joining units, said joining units clasping said reinforced ribs; wherein each said joining unit comprises a first joining piece and a second joining piece, said first joining piece comprises a joining post, and said second joining piece comprises a corresponding joining groove, and said first joining piece and said second joining piece each comprise a clasp groove, said clasp groove receiving a selected one of said reinforced ribs, said joining post and said joining groove serving to connect said first and said second joining pieces.

10. The swimming goggles as cited in claim 9, wherein:

a portion of said front frame unit below said nose bridge conforms to a shape of a nose ridge of the user.

11. The swimming goggles as cited in claim 9, wherein:

said headband device comprises two headband straps and an adjusting snap, ends of said two headband straps being received in said joining units.

12. The swimming goggles as cited in claim 9, wherein:

said first joining piece has a snap post, and snap holes are located between said reinforced ribs of said extended section, such that when said first joining piece is engaged with said second joining piece, said snap post is inserted into said snap hole.

* * * * *